US007933109B2

(12) United States Patent
Mitlmeier et al.

(10) Patent No.: US 7,933,109 B2
(45) Date of Patent: Apr. 26, 2011

(54) ELECTROMAGNETIC SWITCHING DEVICE AND METHOD FOR THE OPERATION THEREOF

(75) Inventors: Norbert Mitlmeier, Ursensollen (DE); Diethard Runggaldier, Stegaurach (DE)

(73) Assignee: Siemens Aktiengesellschaft, Munich (DE)

( * ) Notice: Subject to any disclaimer, the term of this patent is extended or adjusted under 35 U.S.C. 154(b) by 699 days.

(21) Appl. No.: 11/922,206

(22) PCT Filed: Jun. 16, 2005

(86) PCT No.: PCT/DE2005/001082

§ 371 (c)(1),
(2), (4) Date: Dec. 14, 2007

(87) PCT Pub. No.: WO2006/133659

PCT Pub. Date: Dec. 21, 2006

(65) Prior Publication Data

US 2008/0192402 A1 Aug. 14, 2008

(51) Int. Cl.

| | |
|---|---|
| ***H01H 47/00*** | (2006.01) |
| *H01H 9/00* | (2006.01) |
| *H01H 9/22* | (2006.01) |
| *H01H 51/30* | (2006.01) |

(52) U.S. Cl. ..... 361/143; 361/147; 361/160

(58) Field of Classification Search ..... 361/147, 361/143, 160

See application file for complete search history.

(56) References Cited

U.S. PATENT DOCUMENTS

| | | | | |
|---|---|---|---|---|
| 5,406,440 | A * | 4/1995 | Wieloch | 361/154 |
| 6,041,667 | A | 3/2000 | Pischinger et al. | |
| 6,693,787 | B2 * | 2/2004 | Kolmanovsky et al. | 361/160 |
| 6,845,001 | B1 | 1/2005 | Kinbara | |

FOREIGN PATENT DOCUMENTS

| | | |
|---|---|---|
| CN | 1144392 | 3/1997 |
| CN | 1402878 | 3/2003 |
| CN | 1448975 | 10/2003 |
| DE | 198 25 732 | 2/1999 |
| DE | 19825732 A1 | 2/1999 |
| DE | 100 10 756 | 9/2001 |
| DE | 10010756 A1 | 9/2001 |
| WO | WO 01/41174 | 6/2001 |
| WO | WO 0141174 A1 | 6/2001 |

OTHER PUBLICATIONS

PCT/ISA/210.

Office Action for Chinese patent application No. 200580050168.2 dated Apr. 21, 2010.

* cited by examiner

*Primary Examiner* — Dharti H Patel

(74) *Attorney, Agent, or Firm* — Harness, Dickey & Pierce, P.L.C.

(57) ABSTRACT

Disclosed is an electromagnetic switching device including a number of fixed contact pieces, a solenoid-operated mechanism, a contact support which can be moved counter to restoring devices in at least one embodiment, with the aid of the solenoid-operated mechanism and on which a number of movable contact pieces are arranged, and an off stop for the contact support. A sensor is provided, in at least one embodiment, for detecting the position of the contact support while a control unit is provided which is connected to the sensor and regulates and/or controls the solenoid-operated mechanism during a switch-off process in order to decelerate the contact support before the same hits the off stop. Also disclosed is a method for operating such a switching device. The contact support, in at least one embodiment, transmits only a small momentum to the off stop, thus reducing the load applied to the involved parts. Such a switching device therefore has a longer service life than conventional switching devices.

20 Claims, 4 Drawing Sheets

ELECTROMAGNETIC SWITCHING DEVICE AND METHOD FOR THE OPERATION THEREOF

PRIORITY STATEMENT

This application is the national phase under 35 U.S.C. §371 of PCT International Application No. PCT/EP2005/001082 which has an International filing date of Jun. 16, 2005, which designated the United States of America, the entire contents of which are hereby incorporated herein by reference.

FIELD

At least one embodiment of the invention generally relates to an electromagnetic switching device. At least one embodiment of the invention further generally relates to a method for operating such a switching device.

BACKGROUND

In a known switching device, a control or auxiliary current excites the magnet drive, which keeps the movable and the fixed contact pieces in contact with one another in a power circuit as long as the control current flows. Such a switching device is in particular also referred to as a contactor. However, it is likewise also possible to keep the circuit open as long as the control current flows. Then, the power circuit is closed when the magnet drive is switched off. Accordingly, a power circuit can be closed or opened by a weak control current.

If the control current is switched off, the contact carrier accelerates in the direction of the off stop as a result of the stored energies of the restoring device, in the configuration of a contactor the contact between the fixed and the movable contact pieces being opened. As a result of the acceleration, the contact carrier strikes the off stop at high speed.

The contact carrier striking the off stop results in considerable loading of the mechanism of the switching device. In the case of the several million switching cycles which can be achieved nowadays, this results in a high degree of wear not only on the parts directly involved and therefore in the possible life of the switching device being limited. Furthermore, the contact carrier striking the off stop as a result of the enormous acceleration occurring in the process also results in a negative acoustic influence on the surrounding environment.

Furthermore, the switch-off capacity of a switching device in the form of a contactor can be negatively influenced by high rebound values and an associated short-term reduction in the contact opening. This can only be counteracted by the switch-off speed being kept low, as a result of which, however, it is not possible to realize short switching times.

In order to solve the problem mentioned, damping materials on the off stop are known which damp the stop. Disadvantageously, such damping materials have a limited life. The enormous mechanical loading can also only be absorbed to an unsatisfactory extent. The noise loading can therefore also only be reduced within certain limits.

WO 01/41175 A1 has disclosed an electromagnetic switching device, which measures the distance/time response of a contact carrier with the aid of a magnetic field sensor and, as a function of the output signal of the magnetic field sensor, controls the current in the coil of the electromagnet system.

DE 100 10 756 A1 has disclosed a method for regulating the movement sequence of an armature, which method generates, by way of a control loop, a captive current for an electromagnet in order to achieve gentle striking of the armature.

SUMMARY

At least one embodiment of the invention specifies an electromagnetic switching device which has an extended life and a low noise level of the off stop in comparison with conventional switching devices.

At least one embodiment of the invention specifies an operating method for an electromagnetic switching device, with which method an improved life and a lower sound level of the off stop can be achieved in comparison with conventional switching devices.

In accordance with at least one embodiment of the invention, an electromagnetic switching device is disclosed with a number of fixed contact pieces, with a magnet drive and with a contact carrier, which is capable of being moved by the magnet drive counter to restoring devices and on which a number of movable contact pieces is arranged, and with an off stop for the contact carrier by a sensor for detecting the position of the contact carrier and by a control unit, which is connected to the sensor and regulates and/or controls the magnet drive during a switch-off operation for braking the contact carrier before the off stop is struck.

In this case, at least one embodiment of the invention is based on the consideration that, by detecting the position of the contact carrier, it becomes possible to follow the movement sequence of the contact carrier. In particular, it then becomes possible to control the movement of the contact carrier before the off stop is struck. In this case, the detection of the position of the contact carrier can be performed directly at the contact carrier, at parts connected thereto such as the armature or by way of an encoder, which is fixed to the parts which are moved with the contact carrier.

In a further step, at least one embodiment of the invention is based on the knowledge that the magnet drive is used in a switching device of the type mentioned at the outset for accelerating the contact carrier counter to the restoring device. If a control current is applied to the magnet drive in a switch-on position, the armature and therefore the contact carrier is accelerated counter to the restoring device. If the magnet drive is switched off, the contact carrier is accelerated towards the off stop as a result of the restoring device. At least one embodiment of the invention now identifies, in a third step, that the magnet drive can also be used to brake the contact carrier, which is accelerated onto the off stop, counter to the restoring device in a switch-off phase in a targeted manner as a result of its effect of accelerating the contact carrier. Such braking can take place, for example, as a result of a short current pulse onto the magnet drive shortly before the contact carrier strikes the off stop.

As a result of one or more current pulses onto the magnet drive, for example the speed of the contact carrier can be slowed down shortly before the off stop in such a way that the contact carrier strikes the off stop at a speed approaching zero. A control unit is used to control and/or regulate this striking speed which follows the movement or position of the contact carrier by way of the position sensor and by way of the magnet drive influences the speed of the contact carrier before the off stop is struck as a function of these sensor signals.

Suitable sensors are optical, magnetic, mechanical or capacitive sensors. So-called proximity switches can also be used which function with sound, magnetic effects or capacitively. Simple sliding contacts can also be used.

As a result of the braking of the contact carrier before the off stop is struck, the pulse transmitted from the contact carrier to the off stop and therefore the mechanical loading of the component parts in question is considerably reduced. This increases the life of the switching device. Furthermore, the acoustic loading of the environment is markedly reduced.

If the movable contact pieces are brought into contact with the fixed contact pieces in a switch-on position of the magnet drive and are opened in a switch-off position of the magnet drive, the measure additionally has no negative effect on the switch-off delay time since the movement of the contact carrier is braked immediately before the off stop is struck. The current pulses onto the magnet drive can be dimensioned such that the contact carrier is braked a few millimeters before the off stop and strikes it gently. The switch-off rebound can then be regarded as being negligible. Complex mechanical constructions for reducing the switch-off rebound are no longer required and are also not subject to any wear over the life.

In an advantageous configuration, the magnet drive includes an electromagnetic closing coil and an armature, which is connected to the contact carrier. If the closing coil has current flowing through it, owing to the resultant magnetic field the armature and therefore the contact carrier moves towards the coil.

Expediently, the control unit, which is provided for driving or regulating the movement of the contact carrier during a switch-off operation, is also used for opening or closing the contacts per se, i.e. for controlling or regulating the control current for the magnet drive. Only a single control unit which controls or regulates both the switch-on and switch-off operation and the movement of the contact carrier before the off stop is struck is then required for the switching device.

In principle, magnetic or electrical devices can be used as the restoring device. Advantageously, however, mechanical restoring devices, in particular restoring springs, may be used. These are inexpensive and have proven to be successful. In this case, mechanical restoring springs can be used both in the compressing and in the tensioning direction.

Conventionally, in the case of a contactor, influencing of the switch-off operation which is favorable for the stopping of the contact carrier, such as a reduction in the restoring forces, for example, results in an undesired increase in the switch-off delay time of the switching device. Furthermore, in the case of mechanical restoring springs, the restoring force and therefore the acceleration of the contact carrier decreases with increasing proximity to the off stop after the switch-off operation.

In a conventionally constructed switching device, a further increase in the acceleration of the contact carrier after the switch-off operation and thus a further reduction in the switch-off delay time or the switch-off speed is therefore not possible. However, if a control unit is used for influencing the movement profile of the contact carrier, in particular for braking the contact carrier before the off stop is struck, advantageously acceleration devices for accelerating the contact carrier during the switch-off operation in the direction of the off stop can be used. The speed of the contact carrier which is thereby increased in a targeted manner is reduced again before the off stop is struck. If such accelerating devices are used, the switch-off speed of the switching device can be markedly increased.

In a development of at least one embodiment of the invention, a permanent magnet is used as the accelerating device. The use of a permanent magnet for example on the off stop makes it possible to achieve an increase in the restoring force acting on the contact carrier in the direction towards the off stop once the magnet drive has been switched off. The switch-off or contact-opening speed of the switching device is therefore increased.

As an alternative to a permanent magnet, an electromagnetic opening coil can be used. This can be used by way of controlling the current flowing through it for accelerating the contact carrier. In this case, magnet pole faces can be fitted, for example, on the armature, in particular the back of the armature. A coil offers the advantage over a permanent magnet that the acceleration of the contact carrier can be regulated or controlled.

Expediently, the control unit which is already used for braking the contact carrier is also used for regulating or controlling the opening coil.

The object as regards the method for operating for operating an electromagnetic switching device with a number of fixed contact pieces, with a magnet drive and with a contact carrier, which is capable of being moved by the magnet drive counter to restoring device and on which a number of movable contact pieces is arranged, and with an off stop for the contact carrier is achieved in accordance with at least one embodiment of the invention by virtue of the fact that the position of the contact carrier is detected and the magnet drive is controlled or regulated in such a way that, during a switch-off operation, the contact carrier is braked before the off stop is struck.

The abovementioned advantages are achieved with such a method.

Further advantages result if the contact carrier is accelerated towards the off stop before the braking by accelerating device. This results in the above-mentioned shortening of the switch-off time of the switching device in the form of a contactor. It is particularly advantageous if these accelerating devices are controlled and/or regulated.

BRIEF DESCRIPTION OF THE DRAWINGS

Example embodiments of the invention will be explained in more detail by way of drawings, in which.

DETAILED DESCRIPTION OF THE EXAMPLE EMBODIMENTS

Figure 1:
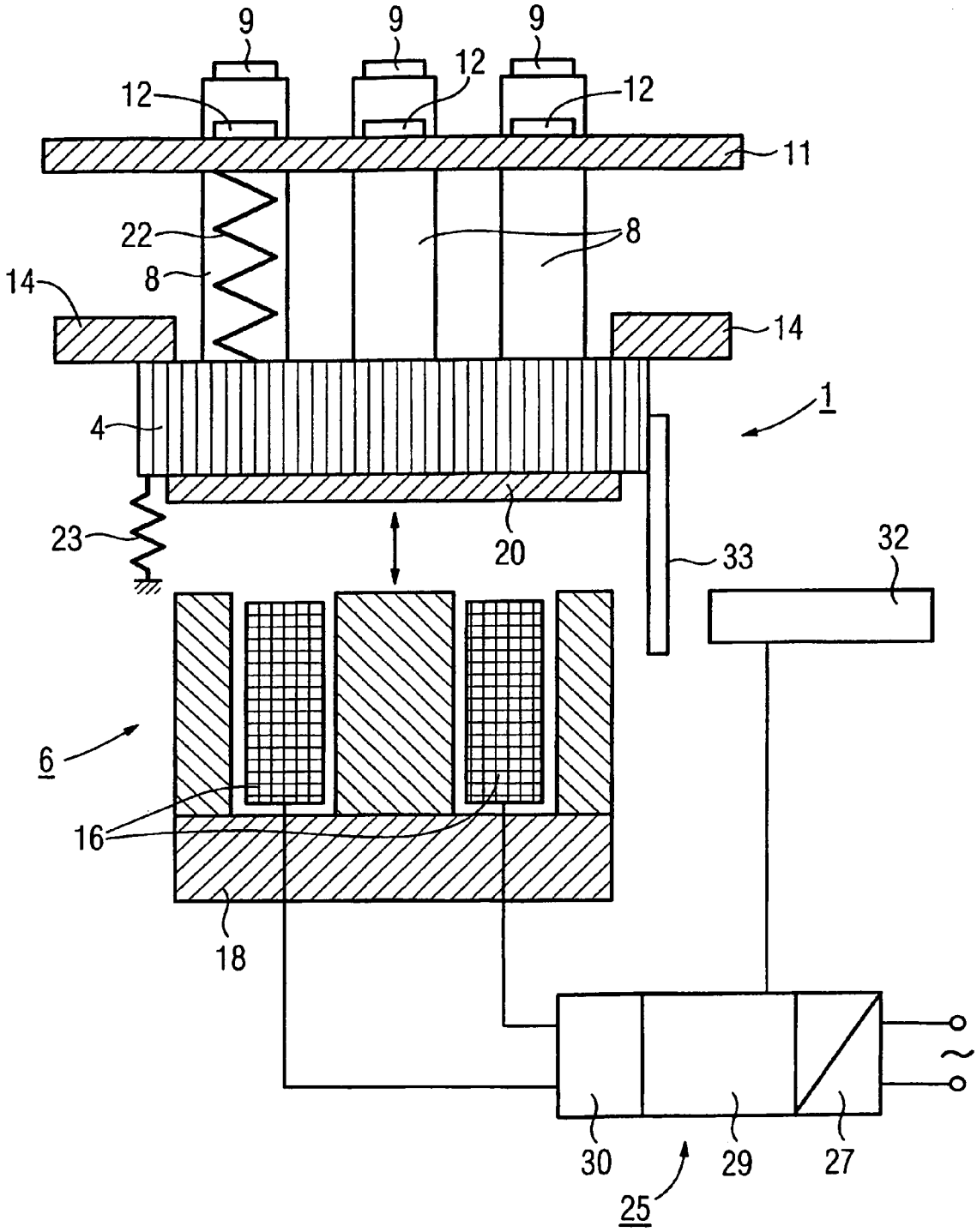
FIG. 1 shows, schematically, a switching device with an off stop for the contact carrier, a magnet drive and a control unit associated therewith for braking the contact carrier.

FIG. 1 shows, schematically, a switching device 1 with a movable contact carrier 4 and a magnet drive 6, which is provided for the movement of the contact carrier 4. The contact carrier 4 has switching piece carriers 8, on whose ends movable contact pieces 9 are positioned. Fixed contact pieces 12 are arranged on a fixed base 11 in front of the switching device 1. At the rear, but not illustrated, there is a further base which has an identical configuration to the base 11 and has further fixed contact pieces. The front fixed contact pieces 12 and the rear fixed contact pieces are integrated in a power circuit to be switched.

In the state illustrated, the power circuit is open; the movable contact pieces 9 are not in contact with the fixed contact pieces 12. The contact carrier 4 rests on the off stop 14. In the closed state, the movable contact pieces 9 are in contact with the fixed contact pieces 12 located at the front by way of the fixed rear contact pieces (not illustrated), as a result of which a power circuit is closed. The movable contact pieces 9 are to a certain extent connected into the power circuit as a bridge.

In order to drive the contact carrier 4, the magnet drive 6 has electromagnetic closing coils 16 and a metallic yoke 18 for closing the magnetic lines of force. If a control current is passed through the closing coils 16, owing to the resultant magnetic field the armature 20 and with it the contact carrier 4, which is fixedly connected thereto, is drawn downwards in the direction towards the closing coils 16. This movement of the contact carrier 4 is counteracted by mechanical main contact springs 22, which are arranged on the switching piece carrier 8, and mechanical return springs 23, attached directly to the contact carrier 4, as the restoring device. For reasons of clarity, in each case only one main contact spring 22 and one return spring 23 is illustrated. When the magnet drive 6 is switched on, the main contact springs 22 are extended and the return springs 23 are compressed, the potential spring energy required for the opening operation thereby being stored.

As long as a control current is flowing through the closing coils 16, the armature 20 and therefore the contact carrier 4 is drawn downwards. The movable contact pieces 9 and the fixed contact pieces 12 come into electrical contact with one another. The power circuit is closed. If the control current through the closing coils 16 is disconnected, the magnetic field holding the armature 20 decays and the contact carrier 4 accelerates as a result of the potential energy stored in the main contact springs 22 and the return springs 23 in the direction towards the off stop 14. During this movement, the electrical contact between the movable contact pieces 9 and the fixed contact pieces 12 is opened.

In order to drive and regulate the magnet drive 6, a control unit 25 is provided which comprises a rectifier 27, a microcontroller 29 and a power module 30. In order to draw power, the rectifier 27 is connected to an AC voltage. The control current flowing via the closing coils 16 is output via the power module 30. The control unit 25 controls the switch-on and the switch-off operation of the switching device 1 via the control current. Furthermore, the microcontroller 29 is connected to a position sensor 32, which detects the position of the contact carrier 4 by way of a sensor encoder 33. In the exemplary embodiment, the sensor encoder 33 is fixed on the contact carrier 4. However, it is likewise easily possible also to use one of the moving parts, such as the contact carrier 4 or the armature 20, for example, itself as the sensor encoder. The position sensor 32 is in the form of an optical sensor, which monitors the position of the contact carrier 4 via markings applied to the sensor encoder 33.

If, starting from a switch-on position of the switching device 1, the control current flowing via the closing coils 16 is switched off with the magnet drive 6 switched on, the contact carrier 4 accelerates towards the off stop 14. The microcontroller 29 in the process monitors the position of the contact carrier 4 by way of the position sensor 32. If a preset position in the immediate vicinity in front of the off stop 14 is detected, the control unit 25 passes one or more current pulses to the closing coils 16, as a result of which the contact carrier 4 is braked. By continuously observing the movement of the contact carrier 4, in the process the striking speed of the contact carrier onto the off stop 14 is regulated down to a fixed value approaching zero. In this way, both the noise level of the stop and the mechanical loads originating from the transmission of pulses to the off stop 14 are low in comparison with conventional switching devices. The life of the switching device 1 is extended in comparison with conventional switching devices. As a result of the striking speed onto the off stop 14 being regulated down, the switch-off rebound value is further improved.

Figure 2:
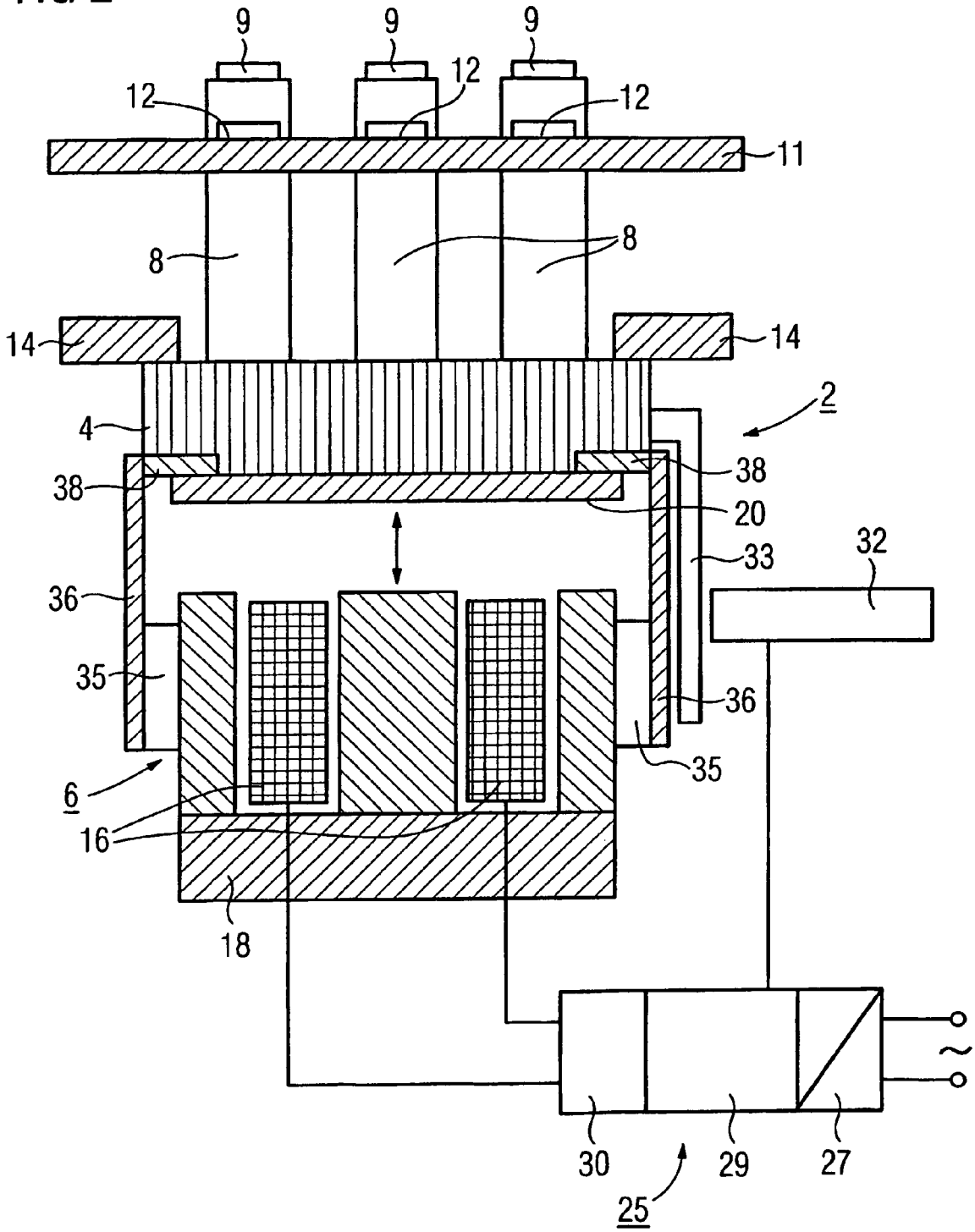
FIG. 2 shows, schematically, a switching device as shown in FIG. 1, a permanent magnet being used for accelerating the contact carrier after the switch-off operation.

FIG. 2 shows a switching device 2, which has in addition, in comparison with the switching device 1 illustrated in FIG. 1, permanent magnets 35 arranged to the side of the magnet drive 6. The main contact springs 22 and return springs 23 used as restoring device are no longer illustrated for reasons of clarity. Furthermore, a fixed magnetic return link 36 is arranged on the permanent magnets 35. In addition, the contact carrier 4 has magnet pole faces 38, which interact with the permanent magnets 35. The magnet pole faces 38 and the permanent magnets 35 are in this case aligned such that a repulsive interaction results between them. The sensor encoder 33 is extended beyond the magnetic return link 36.

In the switched-on state, the armature 20 bears against the magnet drive 6. The fixed contact pieces 12 are in contact with the movable contact pieces 9. The magnet pole faces 38 are at a short distance in the vicinity of the permanent magnets 35. If the control current flowing through the closing coils 16 is disconnected, the contact carrier 4 accelerates towards the off stop 14 owing to the energy stored in the main contact springs 22 and the return springs 23. In addition, the contact carrier 4 is now also accelerated by the repulsive magnetic interaction between the magnet pole faces 38 and the permanent magnets 35. As a result, the opening speed of the contacts is increased or the switch-off delay time of the switching device 2 is further reduced in comparison with the switching device 1.

The additional acceleration of the contact carrier 4 achieved by the permanent magnets 35 in the direction towards the off stop 14 with the associated reduction in the switch-off delay time would be associated with increased mechanical loads and impaired switch-off rebound values at the off stop. However, this is not the case with the switching device 2 shown since, as in the case of the switching device 1, the control unit 25 monitors the position of the contact carrier 4 by way of the position sensor 32 and the sensor encoder 33 and regulates its speed for striking the off stop 14 by targeted driving of the closing coils 16 to an adjusted value. The switching device 2 shown therefore has not only improved switch-off delay time but equally also reduced switch-off rebound values, reduced sound loading and an extended life in comparison with conventional switching devices.

Figure 3:
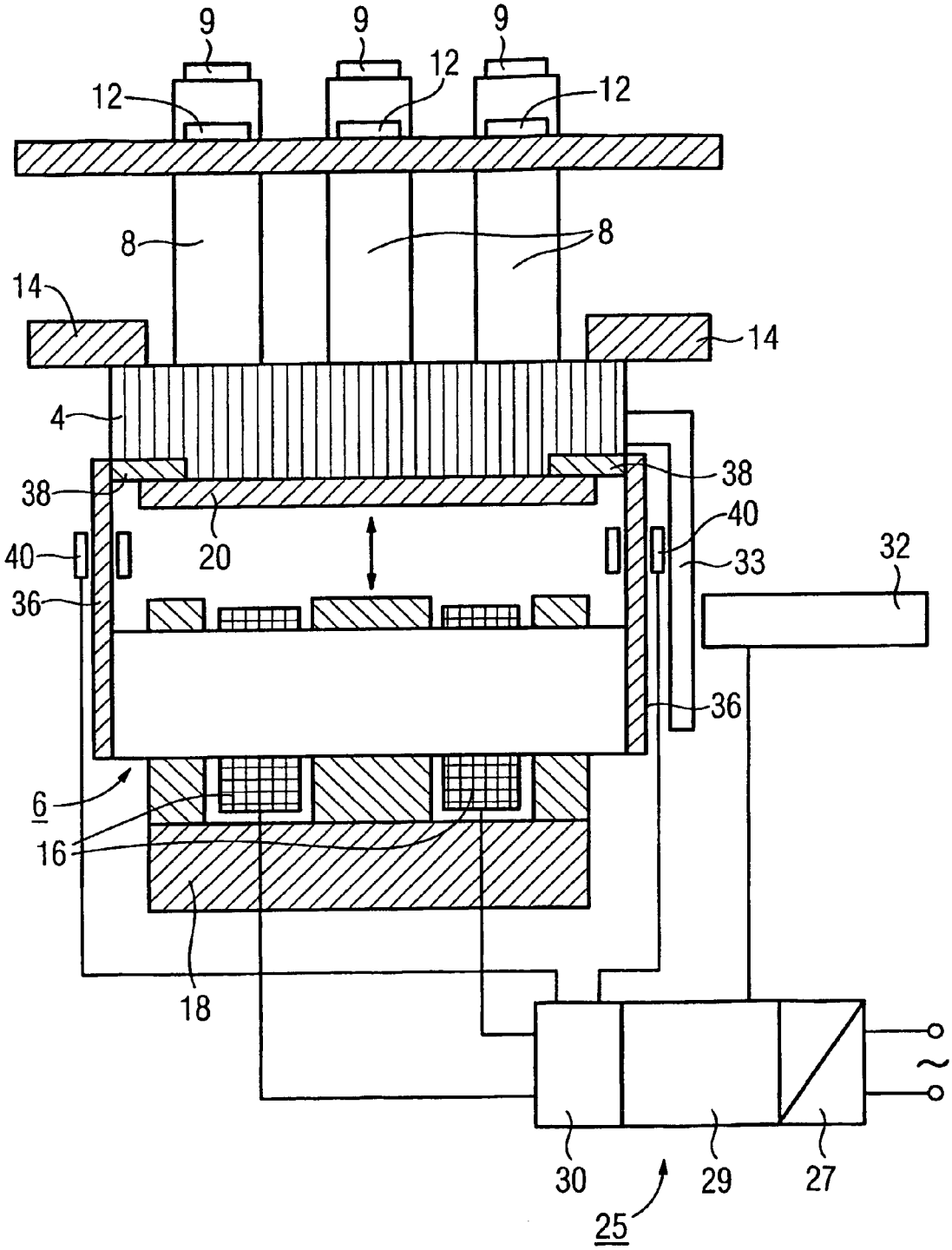
FIG. 3 shows, schematically, a switching device as shown in FIG. 1, an electromagnetic opening coil being used for accelerating the contact carrier after the switch-off operation.

In the switching device 3 shown in FIG. 3, the permanent magnets 35 are replaced by electromagnetic opening coils 40 arranged around the magnetic return link 36. The opening coils 40 are connected to the power module 30 of the control unit 25.

The design of the switching device 3 makes it possible to accelerate the switch-off operation in a controlled or regulated manner by driving the opening coils 40 by way of the control unit 25. A further increase in the switch-off delay time or the contact opening time can thereby be achieved. At the same time, the movement sequence of the contact carrier 4 can be braked gently.

Figure 4:
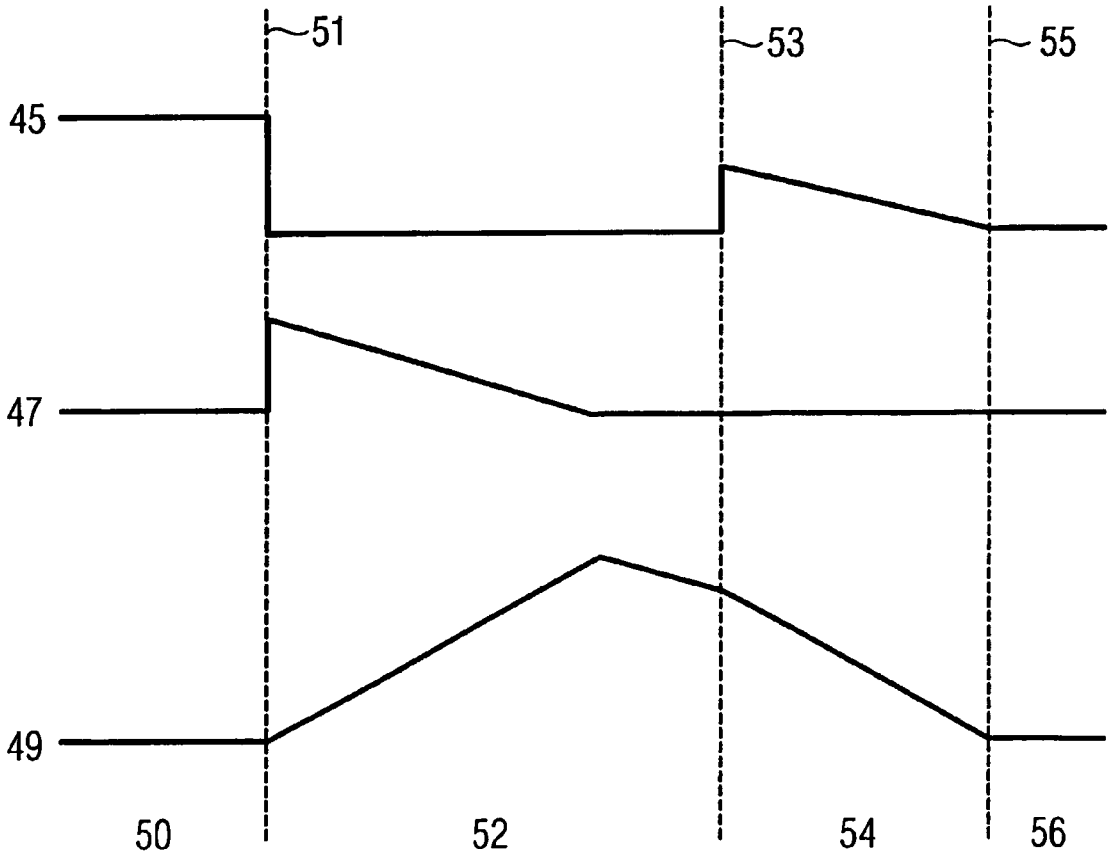
FIG. 4 shows, for a switching device as shown in FIG. 3, in a graph the time profile of the control currents of a closing coil and an opening coil and the speed of the contact carrier during the switch-off operation.

FIG. 4 illustrates, in a simplified graph, plotted over time, for the switching device 3, the current profile 45 of a closing coil 16, the current profile 47 of an opening coil 40 and the speed profile 49 of the contact carrier 4 during the switch-off operation.

At the beginning, the contacts are closed in accordance with section 50 for the switching device 3. A control current is present at the closing coil 16. The opening coil 40 is not driven. The contact carrier 4 is at rest.

At time 51, the control current of the closing coil 16 is disconnected. At the same time, the opening coil 40 in section 52 has a control current applied to it. Both as a result of mechanical restoring devices and owing to the magnetic field being established in the opening coil 40, the contact carrier 4 is accelerated towards the off stop 14. Its speed increases. The switch-off delay time is shortened by the additional acceleration. In order to achieve speeds which are not too high, the control current of the opening coil 40 is reduced gradually. When a preset speed is reached, the control current of the opening coil 40 is disconnected. The force acting on the contact carrier 4 as a result of the mechanical restoring device decreases as the distance increases. In the example shown, this force is insufficient once the control current of the opening coil 40 has been disconnected for maintaining the speed which has been reached. The speed of the contact carrier 4 is reduced.

At time 53, the contacts open. Once the contacts have opened, a control current is again provided to the closing coils 16. This control current results in braking of the movement of the contact carrier 4. As a result of a continuous reduction in the control current of the closing coil 16 in section 54, the speed of the contact carrier 4 is slowed down gently.

At time 55, the contact carrier 4 strikes the off stop 14 virtually at rest. In section 56, the switching device 3 is in the open state. The contact carrier 4 rests on the off stop 14.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromagnetic switching device, comprising:

a magnet drive;

a contact carrier directly connected to at least one restoring device and movable by the magnet drive in a direction counter to the at least one restoring device and on which a number of movable contact pieces is arranged;

an off stop that engages the contact carrier;

a sensor that detects a position of the contact carrier relative to the off stop:

an accelerating device that accelerates the contact carrier during a switch-off operation in the direction of the off stop; and a control unit connected to the sensor and configured to at least one of regulate and control the magnet drive during the switch-off operation by braking the contact carrier before the off stop is struck by the contact carrier.

2. The electromagnetic switching device as claimed in claim 1, wherein the magnet drive includes an electromagnetic closing coil and an armature, the armature being connected to the contact carrier.

3. The electromagnetic switching device as claimed in claim 2, wherein the switch-on and switch-off position of the magnet drive is at least one of regulatable and controllable by the control unit.

4. The electromagnetic switching device as claimed in claim 2, wherein the at least one restoring device includes at least one mechanical restoring device.

5. The electromagnetic switching device as claimed in claim 2, wherein the accelerating device is a permanent magnet.

6. The electromagnetic switching device as claimed in claim 2, wherein the accelerating device is an electromagnetic opening coil.

7. The electromagnetic switching device as claimed in claim 6, wherein the opening coil is at least one of controllable and regulatable by the control unit.

8. The electromagnetic switching device as claimed in claim 1, wherein the switch-on and switch-off position of the magnet drive is at least one of regulatable and controllable by the control unit.

9. The electromagnetic switching device as claimed in claim 1, wherein the at least one restoring device includes at least one mechanical restoring device.

10. The electromagnetic switching device as claimed in claim 9, wherein the at least one mechanical restoring device includes at least one restoring spring.

11. The electromagnetic switching device as claimed in claim 1, wherein the accelerating device is a permanent magnet.

12. The electromagnetic switching device as claimed in claim 1, wherein the accelerating device is an electromagnetic opening coil.

13. The electromagnetic switching device as claimed in claim 12, wherein the opening coil is at least one of controllable and regulatable by the control unit.

14. A method for operating an electromagnetic switching device including a number of fixed contact pieces, a magnet drive and a contact carrier, movable by the magnet drive counter to at least one restoring device and on which a number of movable contact pieces are arranged, and including an off stop for the contact carrier, the method comprising:

detecting a position of the contact carrier; and at least one of controlling and regulating the magnet drive in such a way that the contact carrier is accelerated by at least one accelerating device in a direction towards the off stop;

braking the contact carrier during a switch-off operation before the off stop is struck by the contact carrier.

15. The method for operating an electromagnetic switching device as claimed in claim 14, wherein the at least one accelerating device is at least one of controlled and regulated.

16. An electromagnetic switching device, comprising:

a magnet drive;

a contact carrier, movable by the magnet drive to at least one restoring device, and on which a number of movable contact pieces is arranged;

an off stop that engages the contact carrier;

means for detecting a position of the contact carrier relative to the off stop; and means for at least one of controlling and regulating the magnet drive in such a way that the contact carrier is accelerated in a direction towards the off stop and, during a switch-off operation, is braked before the off stop is struck.

17. The electromagnetic switching device as claimed in claim 16, wherein the magnet drive includes an electromagnetic closing coil and an armature, the armature being connected to the contact carrier.

18. The electromagnetic switching device as claimed in claim 16, wherein the switch-on and switch-off position of the magnet drive is at least one of regulatable and controllable by the means for at least one of controlling and regulating the magnet drive.

19. The electromagnetic switching device as claimed in claim 16, wherein the at least one restoring device includes at least one mechanical restoring device.

20. The electromagnetic switching device as claimed in claim 19, wherein the at least one mechanical restoring device includes at least one restoring spring.

* * * * *